US012421069B2

(12) United States Patent
Schulzetenberg et al.

(10) Patent No.: US 12,421,069 B2
(45) Date of Patent: Sep. 23, 2025

(54) WEB SPLICER

(71) Applicant: 3M INNOVATIVE PROPERTIES COMPANY, St. Paul, MN (US)

(72) Inventors: Bradley H. Schulzetenberg, Eagan, MN (US); Cory J. Cauwels, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 156 days.

(21) Appl. No.: 18/279,317

(22) PCT Filed: Feb. 15, 2022

(86) PCT No.: PCT/IB2022/051333
§ 371 (c)(1),
(2) Date: Aug. 29, 2023

(87) PCT Pub. No.: WO2022/189873
PCT Pub. Date: Sep. 15, 2022

(65) Prior Publication Data

US 2024/0140750 A1 May 2, 2024

Related U.S. Application Data

(60) Provisional application No. 63/159,304, filed on Mar. 10, 2021.

(51) Int. Cl.
*B65H 19/20* (2006.01)
*B65H 19/18* (2006.01)
*B65H 21/02* (2006.01)

(52) U.S. Cl.
CPC ..... *B65H 21/02* (2013.01); *B65H 19/1852* (2013.01); *B65H 19/1873* (2013.01);
(Continued)

(58) Field of Classification Search
CPC . B65H 19/20; B65H 19/1852; B65H 19/1873
See application file for complete search history.

(56) References Cited

U.S. PATENT DOCUMENTS 2,500,273 A 3/1950 Breth
2,702,070 A 2/1955 Lindemann
(Continued)

FOREIGN PATENT DOCUMENTS

EP 0982252 A1 3/2000

OTHER PUBLICATIONS

International Search Report received for PCT International Application No. PCT/IB2022/051333, mailed on May 30, 2022, 5 pages.

*Primary Examiner* — Sang K Kim
(74) *Attorney, Agent, or Firm* — Philip P. Soo

(57) ABSTRACT

An apparatus (100) for splicing a patterned web (108) is provided. The apparatus includes first and second unwind spindles (110, 114) engaging a new roll (112) of patterned web (108) and expiring roll (116) of patterned web, respectively, a first web indexing mechanism (104) capable of linearly translating the patterned web from the new roll (112) along its travel direction; a first clamp surface (129) that extends across the patterned web from the new roll; a second clamp surface (131) that extends across the patterned web from the expiring roll (116); and a cutting mechanism (132, 132') for severing the patterned web from the expiring roll (116). The apparatus further includes a second web indexing mechanism capable of linearly translating the patterned web from the expiring roll along its travel direction, wherein the first and second web indexing mechanisms are independently operable to align registration features of the patterned web on the new roll and expiring roll with each other. The first and second clamp surfaces can be brought
(Continued)

together to create a registered splice of the patterned web between the new and expiring rolls.

15 Claims, 5 Drawing Sheets

(52) U.S. Cl.
CPC .... *B65H 19/20* (2013.01); *B65H 2301/46115* (2013.01); *B65H 2553/40* (2013.01)

(56) References Cited

U.S. PATENT DOCUMENTS

| | | | | |
|---|---|---|---|---|
| 3,615,048 | A | 10/1971 | Martin | |
| 3,659,767 | A | 5/1972 | Martin | |
| 4,096,801 | A | 6/1978 | Martin | |
| 4,141,517 | A | 2/1979 | Olcer | |
| 4,143,829 | A | 3/1979 | Martin | |
| 4,153,218 | A | 5/1979 | Martin | |
| 4,443,291 | A | 4/1984 | Reed | |
| 4,450,309 | A | 5/1984 | Soos et al. | |
| 4,519,858 | A | 5/1985 | Martin | |
| 4,563,324 | A | 1/1986 | Kubat et al. | |
| 4,566,922 | A | 1/1986 | Martinez | |
| 4,612,080 | A | 9/1986 | Aiuola et al. | |
| 4,629,531 | A | 12/1986 | Kataoka | |
| 4,769,098 | A | 9/1988 | Cederholm et al. | |
| 4,801,342 | A | 1/1989 | Wheeler et al. | |
| 4,856,960 | A | 8/1989 | Wheeler et al. | |
| 4,859,270 | A | 8/1989 | Martin et al. | |
| 4,878,986 | A | 11/1989 | Nishikawa | |
| 4,880,178 | A | 11/1989 | Goulette | |
| 4,892,611 | A | 1/1990 | Wheeler et al. | |
| 4,915,282 | A | 4/1990 | Martin et al. | |
| 4,923,546 | A | 5/1990 | Wheeler et al. | |
| 5,009,749 | A | 4/1991 | Cederholm et al. | |
| 5,064,488 | A | 11/1991 | Dickey | |
| 5,212,002 | A | 5/1993 | Madrzak et al. | |
| 5,238,522 | A | 8/1993 | Sakano et al. | |
| 5,284,197 | A | 2/1994 | Cederholm et al. | |
| 5,314,568 | A | 5/1994 | Ryan | |
| 5,335,870 | A | 8/1994 | Martin | |
| 5,337,969 | A | 8/1994 | Martin | |
| 5,360,502 | A | 11/1994 | Andersson | |
| 5,411,223 | A * | 5/1995 | Gatteschi ..... | B65H 19/1852 242/554.2 |
| 5,445,341 | A | 8/1995 | Martin et al. | |
| 5,468,321 | A | 11/1995 | Van et al. | |
| 6,051,095 | A * | 4/2000 | Butterworth ..... | B65H 19/1873 156/286 |
| 6,228,205 | B1 | 5/2001 | Rhodes et al. | |
| 6,603,887 | B1 | 8/2003 | Focke et al. | |
| 6,701,992 | B1 | 3/2004 | Pasquale et al. | |
| 7,022,205 | B2 | 4/2006 | Ward et al. | |
| 11,505,420 | B2 * | 11/2022 | Aprato ..... | B65H 16/00 |
| 2010/0264248 | A1 | 10/2010 | Butterworth | |
| 2012/0100978 | A1 * | 4/2012 | Tommasi ..... | B65H 19/1836 493/227 |
| 2014/0251528 | A1 | 9/2014 | Cederholm et al. | |

* cited by examiner

WEB SPLICER

CROSS REFERENCE TO RELATED APPLICATIONS

This application is a national stage filing under 35 U.S.C. 371 of PCT/IB2022/051333, filed 15 Feb. 2022, which claims the benefit of U.S. Provisional Patent Application No. 63/159,304, filed 10 Mar. 2021, the disclosure of which is incorporated by reference in its/their entirety herein.

FIELD OF THE INVENTION

Provided are mechanisms and methods thereof for splicing a continuously manufactured web.

BACKGROUND

In a manufacturing process for a continuous web, it is often needed to splice the terminal end of the web from an expiring roll and the leading end of the web from a new roll. According to a known method, the expiring web and the new web are threaded between a pair of rollers which are brought together so as to bring a portion of the expiring web into contact with a portion of the new web and then splicing them together by overlaying a suitable adhesive between them. In the case of an overlap splice, this adhesive can be provided by a double-sided adhesive tape previously applied manually by an operator to the leading end of the new web.

SUMMARY

Manufacturing processes can use a variety of web splicing equipment with varying degrees of automation. Unique product specifications and requirements, however, can present challenges in reliably splicing different webs. One of these challenges relates to web registration for webs having a repeating visual pattern that are used for decorative and/or functional purposes. Products produced on converting lines sometimes contain patterns and/or images that are precisely located on the product itself or its packaging. There is a productivity and waste reduction benefit to splice these input webs such that the pattern/image on the web from the expiring roll aligns precisely to the pattern/image on the web of the new input roll. Two webs aligned and spliced in this manner is known as a registered splice. To maximize throughput and reduce costs, there is a significant technical benefit to automatically creating a registered splice with minimal or no disruption to the web manufacturing process.

In a first aspect, an apparatus for splicing a patterned web is provided. The apparatus comprises: first and second unwind spindles engaging a new roll of the patterned web and expiring roll of the patterned web, respectively; a first web indexing mechanism capable of linearly translating the patterned web from the new roll along its travel direction; a first clamp surface that extends across the patterned web from the new roll; a second clamp surface that extends across the patterned web from the expiring roll; a cutting mechanism for severing the patterned web from the expiring roll; and a second web indexing mechanism capable of linearly translating the patterned web along its travel direction from the expiring roll. The first and second web indexing mechanisms are independently operable to align registration features of the patterned web on the new roll and the expiring roll with each other, whereby the first and second clamp surfaces can be brought together to create a registered splice of the patterned web between the new and expiring rolls.

In a second aspect, a process for splicing a patterned web is provided, comprising: using a first web indexing mechanism to position a first segment of the patterned web from a new roll between opposing first and second clamp surfaces at a first registered location; using a second web indexing mechanism to position a second segment of the patterned web from an expiring roll between the opposing first and second clamp surfaces at a second registered location; bringing the first and second clamp surfaces together to create a registered splice; and severing the patterned web from the expiring roll upstream from the registered splice using a cutting mechanism.

Figure 1:
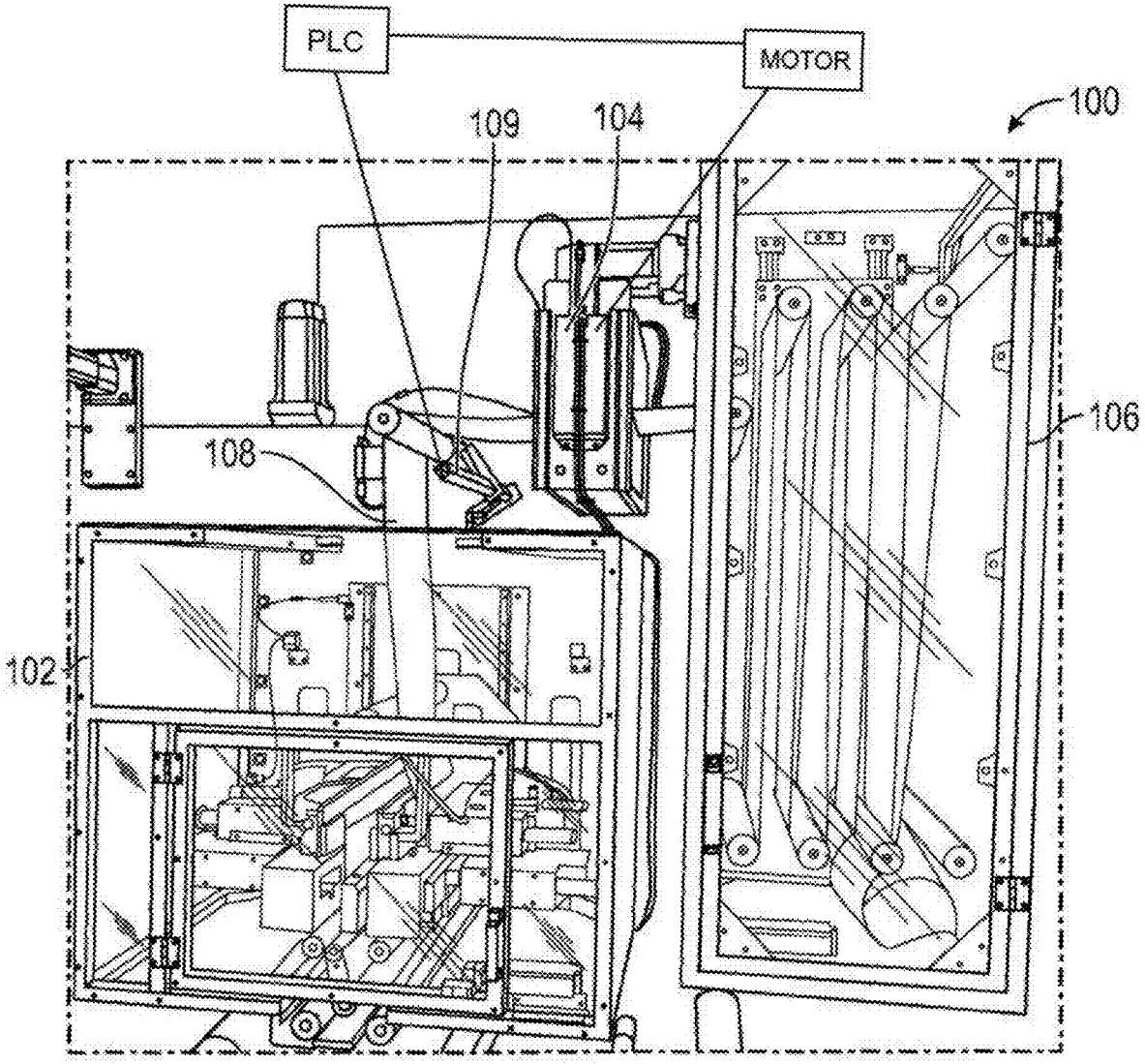
FIG. 1 is a front elevational view of an apparatus for splicing a continuous web according to a first exemplary embodiment.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

As used herein, the terms "preferred" and "preferably" refer to embodiments described herein that can afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/of" means one or all of the listed elements or a combination of any two or more of the listed elements.

It is noted that the term "comprises", and variations thereof do not have a limiting meaning where these terms appear in the accompanying description. Moreover, "a," "an," "the," "at least one," and "one or more" are used interchangeably herein. Relative terms such as left, right, forward, rearward, top, bottom, side, upper, lower, horizontal, vertical, and the like may be used herein and, if so, are from the perspective observed in the particular drawing.

These terms are used only to simplify the description, however, and not to limit the scope of the invention in any way.

Reference throughout this specification to "one embodiment," "certain embodiments," "one or more embodiments" or "an embodiment" means that a particular feature, structure, material, or characteristic described relating to the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Where applicable, trade designations are set out in all uppercase letters.

Provided is an apparatus that can provide a registered splice of two sections of a continuous web. Advantageously, this process can be carried out in an automatic or semi-automatic manner. Useful applications for the apparatus and process include the manufacturing or converting of any web-based products that can have a patterned outer surface. Such webs may be used in adhesive-backed tapes, patterned films, reflective sheeting, commercial laminates, and graphic wraps. Depending on the application, the pattern present on the web can be decorative, functional, or both.

It is desirable for equipment used to splice in new rolls of material while maintaining the pattern to minimize waste generated as a result of a splice. It is common for splices made using conventional methods to generate some number of rejected parts. If registration isn't maintained, however, the equipment could generate large numbers of rejected parts, depending on the sizes of the parts at issue. A second and, potentially greater impact is that if registration is not maintained in some processes, significant down time may result in the manufacturing process as a result of jamming induced in die modules located downstream from the splicer, or causing webs to tear out of the machine.

An exemplary apparatus for splicing a patterned web is shown in FIG. 1 and herein referred to by the numeral 100. The apparatus 100 includes various subassemblies, including a splicing module 102, web indexing mechanism 104, and web accumulator 106. Also illustrated in FIG. 1, a continuous patterned web 108 travels through the aforementioned subassemblies in the same order as listed above.

The splicing module 102, web indexing mechanism 104, and web accumulator 106 cooperatively provide a configuration enabling the web 108 to be continuously dispensed from the apparatus 100 at a constant line speed before, during, and after splicing. Advantageously, this configuration eliminates the need for interruptions during a manufacturing or converting process and helps to maximize throughput, reducing waste and reducing production costs.

Within the apparatus, the splicing module 102 includes a first spindle from which the web 108 is unwound and spliced. The web indexing mechanism 104, located downstream from the splicing module 102, engages and pulls the web 108 from the splicing module 102 at a pre-determined rate. This rate is not particularly limited, and can be controlled by a computer such as a programmable logic controller (PLC) operatively coupled to the web indexing mechanism 104.

The web indexing mechanism 104 can operate using any known way of engaging and moving a continuous web with minimal speed variations. In a preferred embodiment, the web indexing mechanism 104 is comprised of a pull nip. The pull nip is comprised of a pair of nip rollers that are pressed together to grip and draw the web 108 from the splicing module in a controlled manner. It is common for at least one of the nip rollers to be made from a low durometer material (e.g., rubber) so that the rollers maintain good contact with the web 108 and avoid slippage. Motors are generally engaged to the PLC to drive the nip rollers and advance the web 108 upon demand.

As further illustrated in FIG. 1, the web indexing mechanism 104 also includes an upper registration sensor 109. The upper registration sensor 109 is capable of detecting one or more registration features on the web 108. This capability can be used, in turn, to assist the web indexing mechanism 104 in adjusting the position of the web 108 to a precise pre-determined position when creating a registered splice of the web 108. Details of the upper registration sensor 109 and its operation will be described later.

The web accumulator 106 is located downstream from the web and allows for core changes and web splicing to occur while the manufacturing or converting process continues at a constant line speed. The web accumulators can have any known configuration. Festoon-style web accumulators, like the one shown in FIG. 1, are most common, but others such as horizontal coil accumulators could also be possible.

Figure 2:
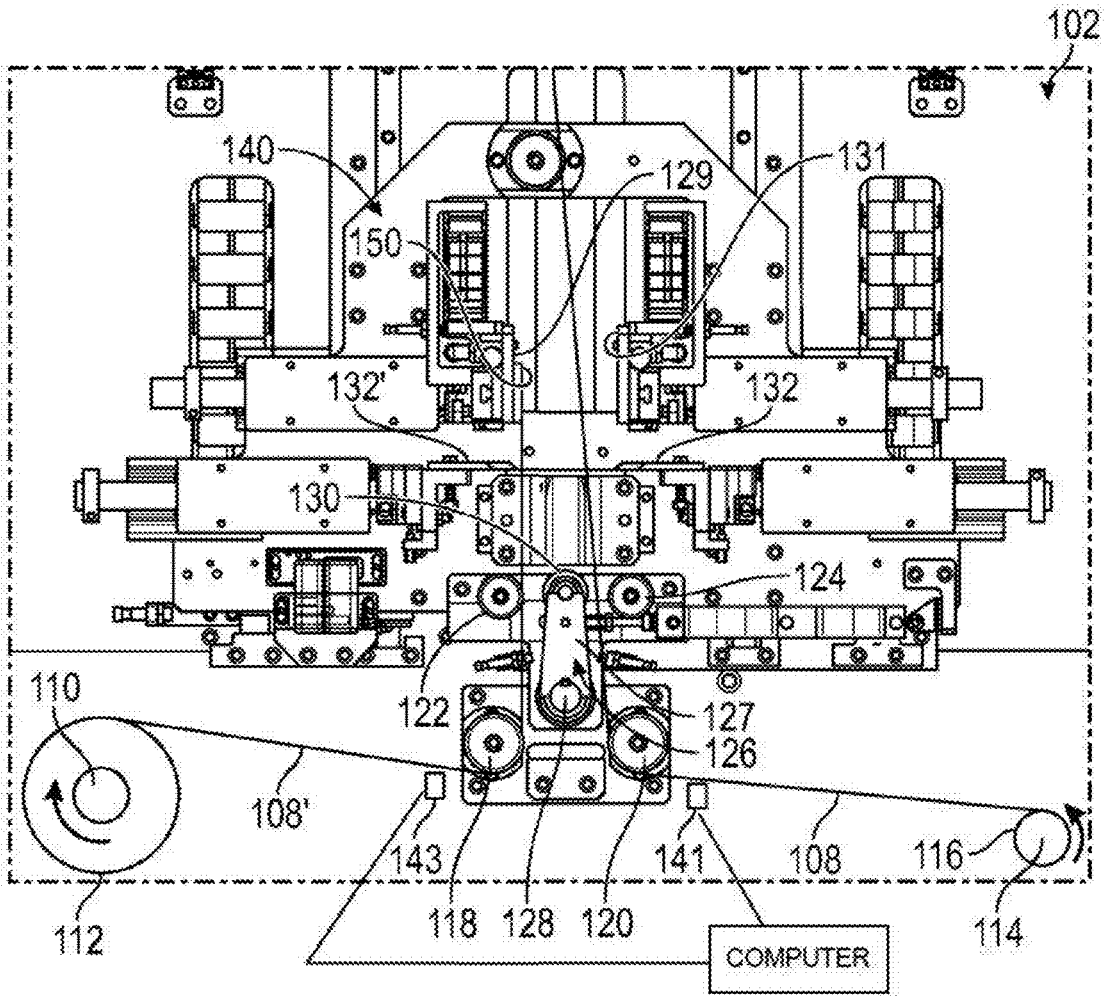
FIG. 2 is a fragmentary view showing a module within of the apparatus of FIG. 1 in preparation of a splicing operation.

FIG. 2 shows features of the splicing module 102 in more detail. As shown, the splicing module 102 includes a first unwind spindle 110 and a second unwind spindle 114. A new roll 112 of web 108' is mounted on the first unwind spindle 110 and an expiring roll 116 of web 108 is mounted on the second unwind spindle 114. The web 108' from the new roll 112, which is to be spliced to the web 108, is guided around lower idler roll 118, upper idler roll 122, and has a terminal segment secured to a first clamp surface 129.

Here, for the sake of clarity, it is noted that the term "patterned web" can be used to refer either to patterned web from the new roll, patterned web from the expiring roll, or both. Where applicable, the numerals 108 and 108' distinguish between these portions of the patterned web, which eventually become one and the same after they are spliced together.

The web 108 from the expiring roll 116 is guided around lower idler roll 120, past upper idler roll 124, past a second clamp surface 131, additional idler rolls, and eventually feeds into the web indexing mechanism 104 (located above the splicing module 102 and not depicted in FIG. 2). In this embodiment, the web 108 does not contact the second clamp surface 131. Sliding contact between these bodies is permissible, however, so long as such contact does not interfere with conveyance of the web 108 through the splicing module 102.

As further shown in FIG. 2, the splicing module 102 is further assisted by a second web indexing mechanism. Optionally, this second indexing mechanism is provided by a holding nip 126 that includes an arm 127 extending upwardly from a pivot joint 128 and terminating in a pressure roll 130. Upon demand, a PLC or other computer can cause the arm to rotate either clockwise or counterclockwise about the pivot joint 128 to nip the web 108', 108 between the pressure roll 130 and the respective upper idler roll 122, 124.

The splicing module 102 further includes a pair of cutting mechanisms 132, 132' located downstream from the holding nip 126 and upstream from the first and second clamp surfaces 129, 131. The cutting mechanism 132, 132' is configured to sever respective web 108, 108' on demand and can be electronically controlled by a computer. In a simple embodiment, the cutting mechanism 132, 132' is comprised of a physical blade capable of slicing the web 108, 108' perpendicular to the direction of web travel (and perpendicular to the plane of the page in FIG. 2). Although not depicted here, it is possible to use a single cutting mechanism capable of selectively cutting either web 108 or web 108'. Cutting mechanisms based on other principles are also possible for certain applications, including those using lasers or high-pressure water jets.

Advantageously, the clamp surfaces 129, 131, holding nip 126, and cutting mechanism 132, 132' are components of a registration carriage 140. The registration carriage 140 is operatively coupled to a motor that allows these components, while having fixed positions relative to each other, to be collectively translated along the direction of web travel. Here, in the figures, the direction of translation is upwards or downwards. Translation of the registration carriage 140 occurs relative to the static components of the splicing module 102, particularly the first and second unwind spindles 110, 114 and lower idler rolls 118, 120. As shown in FIG. 2, the registration carriage can move along a direction that makes a slight angle relative to the web travel direction; these directions need not be precisely parallel with each other.

Adjacent to the webs 108, 108' are lower registration sensors 141, 143, which are located downstream from the first and second unwind spindles 110, 114 and upstream from the lower idler rolls 118, 120. This particular configuration is exemplary only, however, and it is to be understood that the lower registration sensors 141, 143 could achieve their purpose when anchored to any of a number of locations upstream from the registration carriage 140. Moreover, the upper registration sensor 109 can be located any position downstream from the registration carriage 140. Both the upper registration sensor 109 and lower registration sensors 141, 143 thus move independently from the registration carriage 140.

Figure 3:
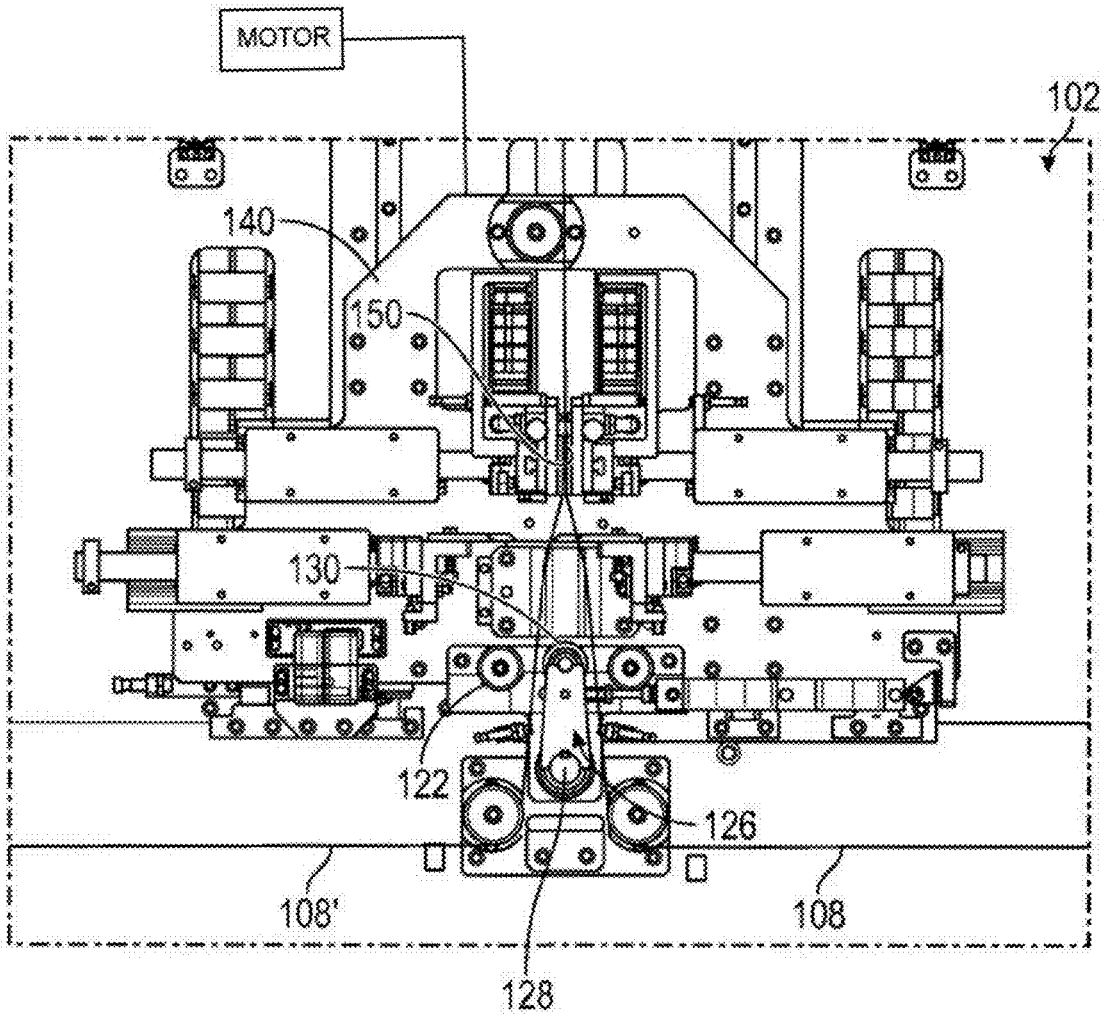
FIG. 3 is a fragmentary view similar to that of FIG. 2 but showing a splicing operation being carried out.

FIG. 3 shows the splicing module 102 in the process of a splicing operation. The steps of this operation shall now be described below with reference to both FIGS. 2 and 3.

At the outset, the web 108' is dispensed from the new roll 112 on the first unwind spindle 110 and threaded up to the first clamp surface 129. The terminal segment of the web 108' can be attached to the first clamp surface 129 using a single-sided adhesive tape 150 (also shown in FIG. 2) whose adhesive-coated side faces towards the opposing second clamp surface 131. The adhesive tape 150, as shown in FIG. 2, extends slightly beyond the terminal segment of the web 108' such that a portion of the adhesive is directly adhered to the web 108' while a remainder of the adhesive is left exposed. The adhesive tape 150 itself can be secured to the first clamp surface 129 pneumatically (e.g., by suction), using a temporary adhesive, clip, or any other reversible fastening mechanism. In an exemplary embodiment, this step is carried out manually by an operator, but this step could be automated if so desired.

With the terminal segment of the web 108' affixed to the first clamp surface 129, the holding nip 126 can then be shifted leftward, clamping the pressure roll 130 web to the upper idler roll 122. This provides sufficient anchorage to assist the registration carriage 140 in pulling the terminal segment of the web 108' upwards along with it, generally in the direction of web travel. The PLC will then instruct a servo motor coupled to the registration carriage 140 to translate it upwards in a linear motion, applying tension to the web 108' while pulling additional material from the new roll 112. In a preferred embodiment, the servo motor and lower registration sensor 143 communicate with each other through the PLC.

While the web 108' is being pulled, the PLC can use the lower registration sensor 143 to locate a pre-determined registration feature on the web 108' from the new roll 112. The registration feature can be any distinctive marking on the web 108' that provides information about the location of the web. Typically, the registration feature is a visual indicia such as a distinctive image, line, edge, pattern, or color. Registration features, in some cases, could be based on a topological feature such as a ridge, groove, or bump.

For detection of visual registration features, a given registration sensor can have any degree of sophistication. In some embodiments, the sensor is an optical sensor. The optical sensor can use any combination of components for lighting, lenses, vision processing, image sensing, and/or communications. The detection of a feature may be achieved using sensors based on a charged couple device (CCD) or a complementary metal oxide semiconductor (CMOS) that converts light into electrical signals. These signals can be processed into a digital image with sufficient detail to provide reliable registration to a particular location on the patterned web 108' and be recognized by processing software. The precision of the location information obtained from the registration sensor can vary depending on the sensor used. In some embodiments, a repeatability of 20 milliseconds, 10 milliseconds, or even 5 milliseconds could be achieved, based on a line speed of 230 centimeters/second. At this line speed, a repeatability of 5 milliseconds corresponds to a spatial resolution of approximately 11 micrometers.

Once this registration feature is detected, the translation of the registration carriage 140 will immediately stop, fixing the web 108' in a registered position and orientation relative to the frame of reference of the apparatus 100.

When the expiring roll 116 is almost depleted, a signal is sent to the PLC indicating that a splicing operation should begin. The PLC then actuates a motor operatively coupled to the web indexing mechanism 104, where both are in communication with an upper registration sensor 109 through the PLC. Assisted by the motor, web indexing mechanism 104 engages and pulls the web 108 from the expiring roll 116 through the splicing module 102 until it detects a pre-determined registration feature on the web 108 from the expiring roll 116. Notably, the registration feature used for positioning the web 108 can be the same as, or different from, the registration feature detected by the lower registration sensor 143 in the earlier step above. Once this registration feature is detected, the PLC commands the web indexing mechanism 104 to stop the web 108.

At this moment, the respective registration features of webs 108, 108' will be precisely aligned with each other between clamp surfaces 129, 131. Therefore, as described in this exemplary process, the holding nip 126, as mounted the registration carriage 140, and the web indexing mechanism 104 independently operate to align registration features of the patterned web 108, 108' on the new roll 112 and expiring roll 116 with each other.

During the time that the web 108 is stopped within the splicing module 102, the web accumulator 106 allows the overall apparatus 100 to continue dispensing the web 108 at a constant and pre-determined rate. At this point two segments of web 108 from the new roll and expiring roll will be aligned with each other along the first and second clamp surfaces 129, 131. The PLC then causes the first and second clamp surfaces 129, 131 to be brought together, creating the registered splice between webs 108, 108'. FIG. 3 shows the configuration of the splicing module 102 at this exact moment.

The cutting mechanism 132 is then activated to sever the web 108 from the expiring roll 116. Once severed, the holding nip 126 and first and second clamp surfaces 129, 131 will disengage and the new roll 112 will begin dispensing the patterned web 108'.

From this moment, the new roll 112 of web 108' will eventually become a new expiring roll and the previous expiring roll 116 can be discarded and replaced with a new roll. Advantageously, the symmetry of the splicing module 102 enables further splicing operations to occur in a continuous fashion, which the new and expiring rolls swapping positions after each splicing operation. In the subsequent splicing operation, designations of rolls 112, 116 (and associated idler rolls 118, 120) are reversed. Further, the lower registration sensor 141 and cutting mechanism 132' would be used in the subsequent splicing operation instead of the lower registration sensor 143 and cutting mechanism 132.

It is preferable that at least some of the aforementioned sequence of steps be carried out in an automated manner. To this end, various steps may be directed with the assistance of a PLC or other computer. For example, a computer can be used to guide one or more of the operations described, including translating the registration carriage 140, stopping the dispensing of the expiring roll 116, the bringing of the first and second clamp surfaces 129, 131 together, and the cutting of the web 108 downstream from the registered splice. In a preferred embodiment of the splicing process, a computer is used to carry out all of these steps in the order provided above.

Figure 4:
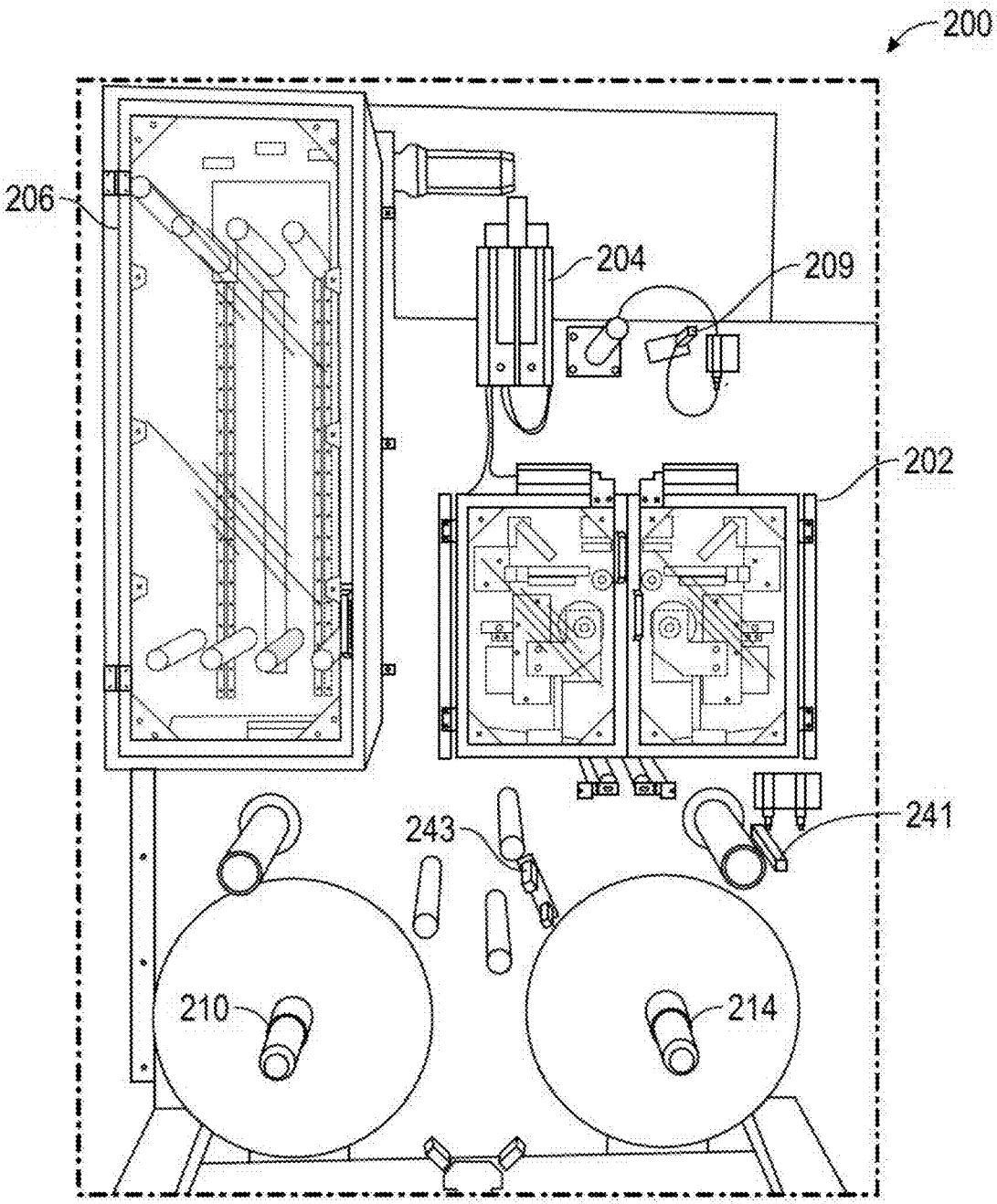
FIG. 4 is a front elevational view of an apparatus for splicing a continuous web according to a second exemplary embodiment.

A second embodiment is shown by apparatus 200 in FIG. 4. The apparatus 200 is configured to provide a butt-splice of the patterned web, rather than an overlap splice. Like apparatus 100, apparatus 200 includes various subassemblies, including the unwind spindles 210, 214, splicing module 202, web indexing mechanism 204, and web accumulator 206. A left registration sensor 241 and right registration sensor 243 are positioned to locate registration features on a continuous patterned web, which is omitted from FIGS. 4 and 5. The continuous patterned web travels through the aforementioned subassemblies in the same order as listed above. Unlike in previously described apparatus 100, there is no registration carriage—each of the aforementioned components are generally fixed in a single frame of reference.

Figure 5:
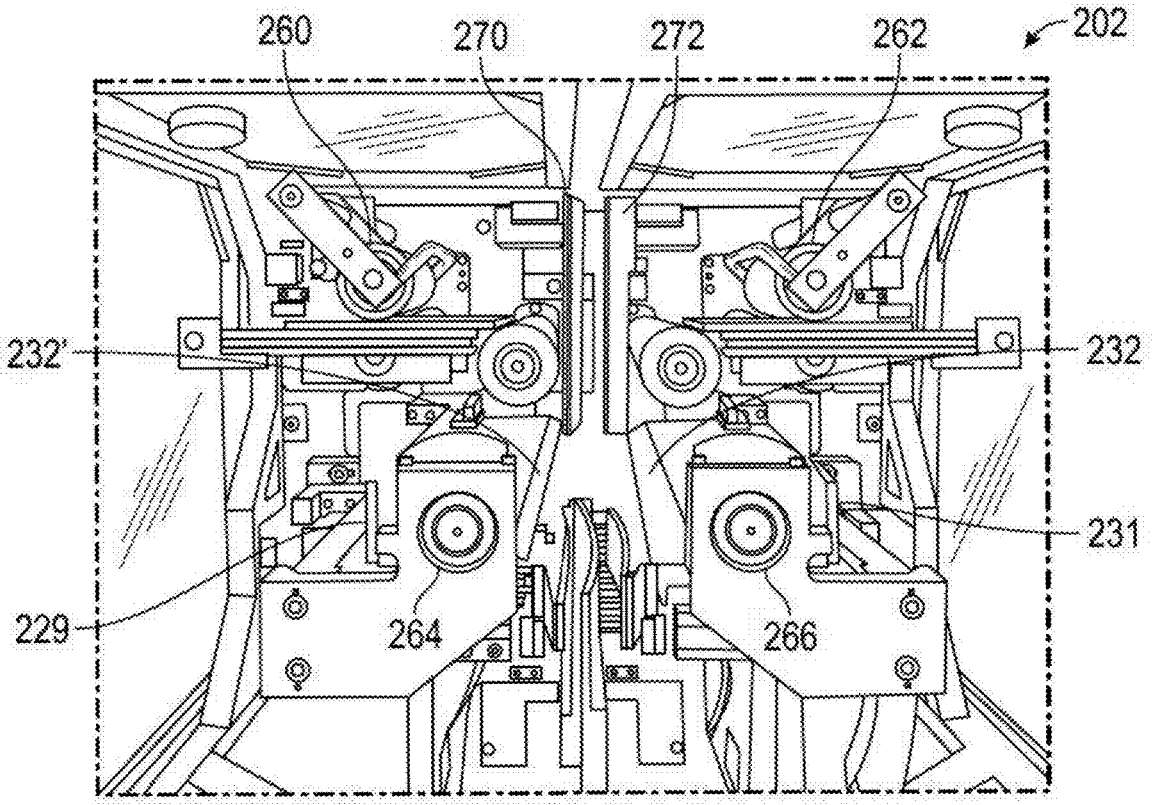
FIG. 5 is a fragmentary view showing a module within the apparatus of FIG. 4.

FIG. 5 shows particular details of the splicing module 202, including holding clamp surfaces 270, 272, first and second tail pull nips 260, 262 and first and second cut drums 264, 266. The first and second cut drums 264, 266 each has a respective cutting mechanism 232', 232 on one side and a respective clamp surface 229, 231 on the other side. Generally, operation of the apparatus 200 is similar in many respects to that of apparatus 100, except the apparatus 200 does not use a web indexing mechanism based on a holding nip on a movable carriage. Instead, the first and second web indexing mechanisms are provided by the web indexing mechanism 204 and either of tail pull nips 260, 262, respectively, depending on whether the new roll is on the first or second unwind spindle 210, 214.

In an exemplary process, a new roll of patterned web is mounted on the first unwind spindle 210 and threaded up through the splicing module 202. Tension is then applied by the tail pull nip 260, which draws the web through the space between the first and second cut drums 264, 266 and immediately stops when a pre-determined registration feature is detected by the left registration sensor 241.

Once the expiring roll from the second unwind spindle 214 is near expiration, the machine will then use the web indexing mechanism 204 interfacing with registration sensor 209 to detect a pre-determined registration feature and lock the expiring portion of the web to a proper registered position. Reaching this position stops the web within the splicing module 202, while the web accumulator 206 allows upstream converting or manufacturing equipment to continue running.

At this point, the portions of the web from the new and expiring rolls will be mutually aligned, allowing the holding clamp surfaces 270, 272 to come together. The terminal ends of the web are then created by severing the new and expiring sections of the web and then immediately splicing them to each other with a strip of adhesive-backed tape. Both of these operations can be executed in quick succession using the first and second cut drums 264, 266, which instantly rotate 180° to toggle between (1) a cutting orientation in which the cutting mechanism 232, 232' cuts the web and (2) a taping orientation where one of the opposing first and second clamp surfaces 229, 231 applies a pre-mounted adhesive-backed tape across the cut. After separating the clamp surfaces 229, 231, the web accumulator 206 can be paused and the upstream manufacturing or converting process resumed. The expired roll can then be replaced with a new roll.

The new and expiring rolls are now reversed on the first and second unwind spindles 210, 214, with the functions of other mirror-image splicing components above similarly switched. Further options and advantages apply to apparatus 200 which are essentially analogous to those already described with respect to apparatus 100 and need not be repeated here.

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. An apparatus for splicing a patterned web comprising:

first and second unwind spindles engaging a new roll of the patterned web and expiring roll of the patterned web, respectively;

a first web indexing mechanism capable of linearly translating the patterned web from the new roll along its travel direction;

a first clamp surface that extends across the patterned web from the new roll;

a second clamp surface that extends across the patterned web from the expiring roll;

a cutting mechanism for severing the patterned web from the expiring roll;

a second web indexing mechanism capable of linearly translating the patterned web along its travel direction from the expiring roll; and a registration carriage capable of being translated along a travel direction of the patterned web, wherein the first and second clamp surfaces, the first web indexing mechanism, and the cutting mechanism are coupled to the registration carriage and the first and second unwind spindles and the second web indexing mechanism are not coupled to the registration carriage, wherein the first and second web indexing mechanisms are independently operable to align registration features of the patterned web on the new roll and the expiring roll with each other, whereby the first and second clamp surfaces can be brought together to create a registered splice of the patterned web between the new and expiring rolls.

2. The apparatus of claim 1, wherein the registration carriage further comprises a holding mechanism to assist in pulling the patterned web from the first unwind spindle as the registration carriage is linearly translated.

3. The apparatus of claim 2, wherein the holding mechanism comprises a holding nip.

4. The apparatus of claim 1, further comprising a first registration sensor located downstream from the first unwind spindle and upstream from the registration carriage and capable of detecting a registration feature on the patterned web.

5. The apparatus of claim 4, further comprising a first motor for linearly translating the registration carriage, the first motor being in communication with the first registration sensor.

6. The apparatus of claim 4, further comprising a second registration sensor located downstream from the registration carriage and capable of detecting a registration feature on the patterned web.

7. The apparatus of claim 6, further comprising a second motor for operating the first web indexing mechanism, the second motor being in communication with the second registration sensor.

8. The apparatus of claim 7, further comprising at least one programmable logic controller in communication with each registration sensor and each motor, the at least one programmable logic controller capable of causing the first and second clamp surfaces to be brought together after registration of the patterned web between the new and expiring rolls has been determined.

9. The apparatus of claim 1, wherein each of the first and second web indexing mechanisms comprises a pull nip.

10. A process for splicing a patterned web comprising:

using a first web indexing mechanism to position a first segment of the patterned web from a new roll between opposing first and second clamp surfaces at a first registered location;

using a second web indexing mechanism to position a second segment of the patterned web from an expiring roll between the opposing first and second clamp surfaces at a second registered location;

bringing the first and second clamp surfaces together to create a registered splice; and severing the patterned web from the expiring roll upstream from the registered splice using a cutting mechanism, wherein the first and second web indexing mechanisms are guided by respective first and second registration sensors capable of detecting registration features on the patterned web.

11. The process of claim 10, wherein the first and second registration sensors are optical sensors in communication with a computer.

12. The process of claim 11, wherein the computer is further in communication with first and second motors that operate the first and second web indexing mechanisms, respectively.

13. The process of claim 10, wherein the first segment of the patterned web is positioned by linearly translating a registration carriage along a travel direction of the patterned web, wherein the first and second clamp surfaces, the first web indexing mechanism, and the cutting mechanism are coupled to the registration carriage and the second web indexing mechanism is not coupled to the registration carriage.

14. The process of claim 13, wherein a computer automatically executes one or more of: translating the registration carriage, stopping the dispensing of the expiring roll, bringing of the first and second clamp surfaces together, and severing of the patterned web upstream from the registered splice.

15. The process of claim 14, wherein the computer automatically executes each of: translating the registration carriage, stopping the dispensing of the expiring roll, the bringing of the first and second clamp surfaces together, and the severing of the patterned web upstream from the registered splice, in the order provided.

* * * * *